US006393243B1

(12) United States Patent
Satoh et al.

(10) Patent No.: US 6,393,243 B1
(45) Date of Patent: May 21, 2002

(54) DEVELOPING ROLLER AND DEVELOPING DEVICE USING THE SAME

(75) Inventors: Hidenori Satoh, Tokyo; Noriyuki Yanai, Kanagawa; Kentaro Niwano, Kanagawa; Arihiro Yamamoto, Kanagawa, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/858,961

(22) Filed: May 17, 2001

(30) Foreign Application Priority Data

May 23, 2000 (JP) ..... 2000-151700

(51) Int. Cl.[7] ..... G03G 15/08
(52) U.S. Cl. ..... 399/286; 399/279
(58) Field of Search ..... 399/286, 279, 399/265; 430/120; 492/18, 49, 53, 56

(56) References Cited

U.S. PATENT DOCUMENTS 5,353,104 A 10/1994 Kato et al. ..... 399/274
5,552,199 A * 9/1996 Blong et al. ..... 428/36.9
5,697,027 A 12/1997 Takagi et al. ..... 399/279

FOREIGN PATENT DOCUMENTS

JP 9-222788 8/1997
JP 11-045013 * 2/1999

* cited by examiner

*Primary Examiner*—Sophia S. Chen
(74) *Attorney, Agent, or Firm*—Fitzpatrick, Cella, Harper & Scinto

(57) ABSTRACT

A developing roller having a superior setting ability and having a uniform and high conductivity is provided by improving dispersion and stability of carbon black mixed in a solution of a coating resin, and then forming a resin layer that has a low modulus of elasticity and a high conductivity when coated. The developing roller includes a core shaft, an elastic body layer formed around the core shaft and made of rubber as a main ingredient, and a resin layer coated at least on an outer surface of the elastic body layer. The resin layer contains carbon black having a DBP absorption amount of 80 to 110 ml/100 g, a ratio of a DBP absorption amount to a nitrogen specific surface area being not more than 0.012 $ml/m^2$, and a ratio of a volatile component to a nitrogen specific surface area being not more than $2.0\times10^{-4}$ $g/m^2$.

10 Claims, 2 Drawing Sheets

DEVELOPING ROLLER AND DEVELOPING DEVICE USING THE SAME

BACKGROUND OF THE INVENTION

1. Field of the Invention

The present invention relates to a developing roller used in contact with a photoconductive member which is assembled in an apparatus utilizing electrophotographic techniques, such as a copying machine, a printer, or a facsimile receiving unit. The present invention also relates to a developing device using the developing roller.

2. Description of the Related Art

For charging a photoconductive member or visualizing an electrostatic latent image, an electrophotographic apparatus, e.g., a copying machine, a facsimile or a printer, generally employs an elastic roller having conductivity (electrical resistance) that is in the semiconductor range of $10^3$–$10^{10}\Omega$ and is suitable for its objective function. In an electrophotographic apparatus utilizing a one-component developing method, for example, an electrostatic latent image is visualized for development with a developer (toner) carried to a photoconductive member (drum) through developing rollers that are arranged in a pressure contact state with each other. An elastic roller for use in such an electrophotographic apparatus is required to easily deform and have a good restoring ability from a deformed state, because the elastic roller must be brought into pressure contact with the photoconductive member over a predetermined width or it must hold thereon the developer in the form of a thin layer with the aid of a blade or the like. The elastic roller is also required to have uniform conductivity at an appropriate level in the range of $10^4$–$10^8\Omega$ so that a developed image will not undergo unevenness.

To satisfy those requirements, a roller comprising a core shaft and an elastic body layer, which is made of a silicone rubber material given with conductivity and is formed around the core shaft, has hitherto been employed for the above-stated type of roller, particularly a developing roller concerned with the present invention.

However, such a conventional developing roller has the following drawbacks due to characteristics of its elastic body layer.

When employing elastic rubber to form the developing roller, if a rubber having a low hardness is selected to obtain a good ability of following to the surface of the photoconductive member, contamination of the photoconductive member would occur sometimes. Further, the use of a rubber having a low hardness would cause a difficulty in polishing the roller surface, thus resulting in an unsatisfactory roller surface.

In the case of employing a method of forming a surface layer to avoid contamination of the photoconductive member and to obtain a satisfactory surface of the developing roller, if the surface layer contains no conductive powder, the resistance of the overall surface layer would be so increased that the obtained roller may not function as a developing roller. Conversely, if the surface layer contains a large amount of conductive powder, the modulus of elasticity would be excessively increased and a restoring ability from a deformed state (also called a setting ability) required for the developing roller would not be provided. When adding carbon black, particularly, low electrical resistance is obtained, but the required setting ability cannot be obtained because of the surface layer having a high modulus of elasticity. In addition, surface properties and resistance greatly vary depending on a degree of dispersion of the carbon black in the surface layer.

Japanese Patent Laid-Open No. 9-222788 discloses a conductive layer using carbon black having a low structure (oil (DBP) absorption amount of not more than 80 ml/100 g). However, the conductive layer disclosed in Japanese Patent Laid-Open No. 9-222788 has a problem that, because the carbon black used therein has a low effect in applying conductivity, a large amount of carbon black must be mixed to obtain a sufficient conductivity. Consequently, the modulus of elasticity of a rubber composition is excessively increased. Also, it is explained in the Publication that when using carbon black with an oil absorption amount of more than 80 ml/100 g, the amount of carbon black added is relatively small and a difficulty is caused in obtaining satisfactory dispersion and stability of the carbon black in a solution of a coating resin and hence in controlling an appropriate conductivity stably.

The term "structure" used regarding carbon black means an aggregated condition of carbon black particles. The carbon black (CB) is present in a condition where CB particles are fused with each other, which is called an aggregate and compared to a cluster of grapes from a similarity in the concept of configuration. A degree of development into the aggregate is referred to as a "structure" and classified into high, normal (medium) and low levels. A level of the structure greatly affects reinforcement and extrusion characteristics of rubber in which carbon black is mixed, and dispersion, tinting power, viscosity and conductivity resulting when carbon black is used in inks, paints, colored resins, etc.

SUMMARY OF THE INVENTION

There is a demand for higher performance required in a developing roller which is employed in an apparatus utilizing electrophotographic techniques, such as a copying machine, a printer, or a facsimile receiving unit, and a particular demand resides in uniform conductivity and a restoring ability from a deformed state (setting ability), which are required for realizing a high resolution. Accordingly, it is an object of the present invention to provide a developing roller, which has a superior setting ability and has a uniform and high conductivity, by improving dispersion and stability of carbon black mixed in a solution of a coating resin, and then forming a resin layer that has a low modulus of elasticity and a high conductivity when coated.

Another object of the present invention is to provide a developing device using the developing roller.

To achieve the above objects, the inventors have carried out intensive researches and studies. As a result, the inventors have accomplished the present invention based on the following findings. By dissolving carbon black, which has a DBP (herein, "DBP represents dibutyl phthalate.) absorption amount to a nitrogen specific surface area being not more than 0.012 ml/m$^2$, and a ratio of a volatile component to a nitrogen specific surface area being not more than $2.0\times10^{-4}$ g/m$^2$, in a solvent together with a resin to form a solution of a conductive component, it is possible to obtain an intended resistance value of a coated resin layer and intended dispersion and stability of the carbon black in the solution of the conductive composition. In particular, satisfactory dispersion and stability of the carbon black in the solution of the coating resin can be obtained by selecting a balance in the particle size and the structure level of the carbon black having the DBP absorption amount of more than 80 ml/100 g, which has been regarded as difficult to perform stable control to provide an appropriate conductivity (as explained in Japanese Patent Laid-Open No. 9-222788), so that the carbon black exhibits good dispersion in the solution and has a surface activity (volatile component) keeping the carbon black hard to aggregate again.

Also, in the process of accomplishing the present invention, the inventors have found that, by using the carbon black having such a low reinforcing ability, an increase in the modulus of elasticity is suppressed to be small and a multilayer coating laminated on a roller is avoided from becoming too hard, and that a satisfactory setting ability (restoring ability from a deformed state) can be obtained while sufficiently developing properties of the other layer. Stated otherwise, when a material having a superior setting ability, such as silicone rubber, is used to form an elastic body layer, the specific setting ability of the material can be maintained.

Thus, a developing roller of the present invention comprises a core shaft, an elastic body layer formed around the core shaft and made of rubber as a main ingredient, and a resin layer coated at least on an outer surface of the elastic body layer, wherein the resin layer contains carbon black having a DBP absorption amount of 80 to 110 ml/100 g, a ratio of a DBP absorption amount to a nitrogen specific surface area being not more than 0.012 $ml/m^2$, and a ratio of a volatile component to a nitrogen specific surface area being not more than $2.0\times10^{-4}$ $g/m^2$.

Also, a developing device of the present invention includes a developing roller for carrying a developer in a state of abutment or pressure contact with an opposing latent-image bearing member for bearing a latent image thereon, the developing roller applying the developer to the latent-image bearing member, thereby visualizing the latent image into a developer image, wherein the developing roller is constituted as above-described.

Further objects, features and advantages of the present invention will become apparent from the following description of the preferred embodiments with reference to the attached drawings.

DESCRIPTION OF THE PREFERRED EMBODIMENTS

The elastic body layer containing rubber as a main ingredient is preferably primarily made of silicone rubber. Further, the resin layer is preferably primarily made of a urethane resin.

An amount of the carbon black added to the resin layer is preferably in the range of 5 to 85 weight parts with respect to 100 weight parts of the resin forming the resin layer.

Moreover, a film thickness of the resin layer is preferably in the range of 0.1 to 100 $\mu$m.

Figure 1:
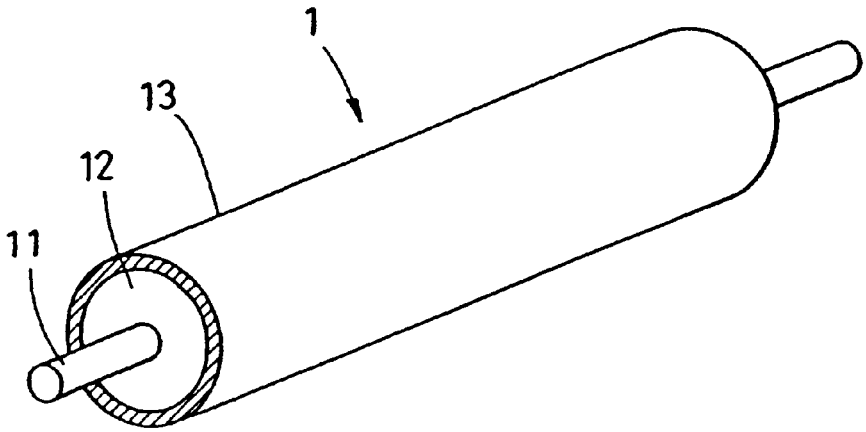
FIG. 1 is an explanatory perspective view of a developing roller according to one embodiment of the present invention.
Figure 2:
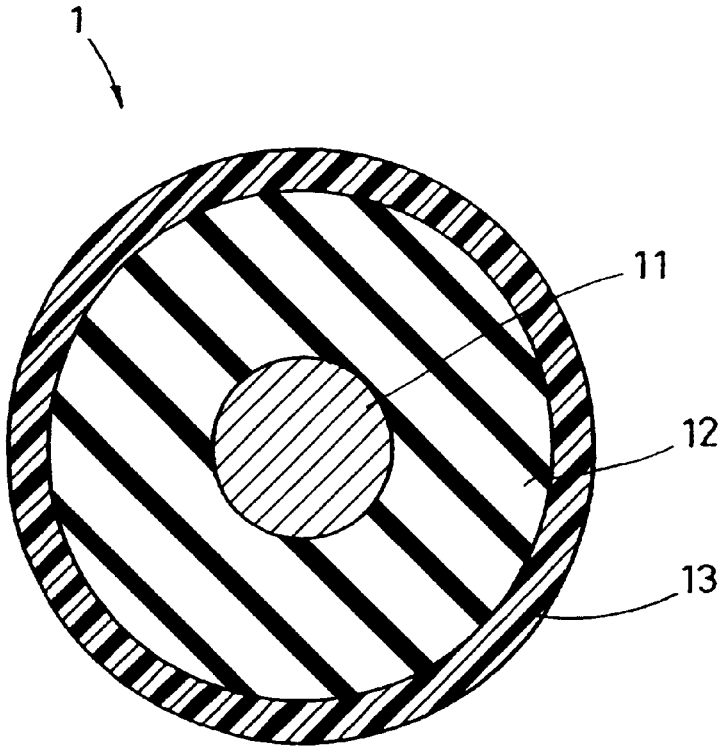
FIG. 2 is a sectional view of the developing roller shown in FIG. 1.

As shown in FIGS. 1 and 2, a developing roller 1 comprises a conductive core (shaft) 11 having a columnar or hollow cylindrical shape, and a conductive multilayer coating formed around the conductive core 11. The conductive multilayer coating is made up of an elastic body layer 12 fixed to an outer circumferential surface of the conductive core 11, and a resin layer 13 formed on an outer circumferential surface of the elastic body layer 12. While the resin layer 13 is an outermost surface layer in an embodiment of FIG. 2, another elastic body layer or resin layer may be formed on the outer circumferential surface of the elastic body layer 12 or the resin layer 13. The conductive core 11 functions as an electrode and a supporting member for the conductive multiplayer coating, and is made of a conductive material, e.g., a metal or an alloy such as aluminum, a copper alloy and stainless steel, and iron or a synthetic resin plated with chromium, nickel, etc. An outer diameter of the conductive core 11 is usually in the range of 4 to 10 mm.

The elastic body layer 12 is selected to have appropriate values of hardness and electrical resistance so that the conductive multilayer coating can press the surface of a member to be charged with an appropriate nip width and nip pressure and can uniformly charge the target surface. The elastic body layer 12 is formed of a molding of rubber materials. Various rubbers, which have hitherto been used in conductive rubber rollers, may be used as the rubber materials. Those rubber materials include, e.g., ethylene-propylene-diene copolymer rubber (EPDM), acrylonitrile-butadiene rubber (NBR), chloroprene rubber (CR), natural rubber (NR), isoprene rubber (IR), styrene-butadiene rubber (SBR), fluoro-rubber, silicone rubber, epichlorohydrine, hydride of NBR, polysulfide rubber, and urethane rubber, which are used solely or as a mixture of two or more.

Particularly, silicone rubber is preferably used as the elastic body layer 12 because the use of silicone rubber provides a superior setting ability. Examples of silicone rubber include polydimethyl siloxane, polymethyl-trifluoropropyl siloxane, polymethylvinyl siloxane, polytrifluoropropylvinyl siloxane, polymethylphenyl siloxane, polyphenylvinyl siloxane, and copolymers of two or more of these polysiloxanes. An average degree of polymerization of the above examples of the silicone rubber is preferably in the range of 3000 to 15000.

In the rubber material, various additives, such as a non-conductive filler, a cross-linking agent, a catalyst, a dispersion aid, are mixed, as required, in addition to a conductive agent as an essential ingredient.

The conductive agent may be fine powder of various conductive metals or alloys such as carbon black, graphite, aluminum, copper, tin and stainless steel, various conductive metal oxides such as tin oxide, zinc oxide, indium oxide, titanium oxide, solid solution of tin oxide—antimony oxide and solid solution of tin oxide—indium oxide, and insulating materials coated with these conductive materials. Among the above examples, carbon black is relatively easily available and can provide a good charging ability. As a dispersing means, a roll kneader, a Banbury mixer, a ball mill, a sand grinder, a paint shaker, etc. may be used as appropriate.

Furthermore, a conductive high molecular compound may also be used for imparting conductivity to the rubber material. Such a compound is made up of, e.g., a host polymer and a dopant. Examples of the host polymer include polyacetylene, poly(p-phenylene), polypyrrole, polythiophene, poly(p-phenyleneoxide), poly(p-phenylenesulfide), poly(p-phenylenvinylene), poly(2,6-dimethylphenyleneoxide), poly(bisphenol A carbonate), polyvinylcarbazole, polydiacetylene, poly(N-methyl-4-vinylpyridine), polyaniline, polyquinoline, and poly (phenylene ether sulfone). Then, at least one of ions of $AsF_5$, $I_2$, $Br_2$, $SO_3$, Na, K, $ClO_4$, $FeCl_3$, F, Cl, Br, I and Kr, as well as Li and TCNQ, etc. is doped as a dopant in any of the above examples of the conductive high molecular compound.

Examples of the nonconductive filler include diatomite, quartz powder, dried silica, wet silica, titanium oxide, zinc oxide, aluminosilicate, and calcium carbonate. Examples of the cross-linking agent include di-t-butylperoxide, 2,5-dimethyl-2,5-di(t-butylperoxy)hexane, dicyml peroxide, t-butylperoxybenzoate, and P-chlorobenzoylperoxide.

Silica is not limited to particular types, but may be selected from a wide range of conventionally known ones. For example, silicic anhydride prepared by the dry process, silicic hydrate prepared by the wet process, and synthesized silicates are usable. The amount of silica contained in the elastic body layer 12 may be determined to appropriate values so as to develop satisfactory hardness and other characteristics of the elastic body layer 12. From the standpoint of contributing to an increase of adhesion, however, the amount of silica is preferably in the range of 10 to 120 weight parts and more preferably in the range of 20 to 80 weight parts. If the amount of silica added is less than 10 weight parts, no effect of contributing to an increase of adhesion would be obtained. On the other hand, if the amount of silica added is more than 120 weight parts, the hardness of the elastic body layer would be increased too much and the characteristics of silicone rubber would not be developed sufficiently.

A volume specific resistance value of the conductive elastic body layer is preferably in the range of $10^3$ to $10^{10}$ Ω·cm when a DC voltage of 100 V is applied. For example, when using carbon black as the conductive agent, 5 to 1000 weight parts of carbon black is added to the rubber material. Also, a thickness of the elastic body layer 12 is in the range of 0.5 to 6.0 mm and preferably in the range of 1.0 to 5.0 mm. The elastic body layer 12 having a thickness greater than 0.5 mm can provide a uniform nip. However, even if the thickness of the elastic body layer is increased above 6.0 mm, a charging ability would no longer be improved and the elastic body layer would be less cost effective because of an increased molding cost of the rubber material.

A component forming the resin layer 13 is not limited to particular types, but a polyamide resin, a urethane resin, or a urea resin is preferably employed from the standpoints of film reinforcement, a toner charging ability, etc.

The urethane resin is prepared, for example, by a method of mixing carbon black in a polyurethane prepolymer and subjecting the prepolymer to a cross-linking reaction, or by a method of mixing a conductive material in a polyol and reacting the resulted polyol with polyisocyanate using the one-shot process.

In that case, a polyhydroxyl compound used in preparing polyurethane may be, for example, any of polyols that are used in producing general soft polyurethane foams and urethane elastomers, such as polyether polyol having a polyhydroxyl group as a terminal group, polyester polyol, and polyether polyester polyol that is a copolymer of the two formers. Additionally, general polyols including polyolefin polyols such as polybutadiene polyol and polyisoprene polyol, the so-called polymer polyols prepared by polymerizing ethylene-based unsaturated moieties in polyols, etc. are also usable. Likewise, an isocyanate compound may be, for example, any of polyisocyanates that are used in producing general soft polyurethane foams and urethane elastomers, such as tolylenediisocyanate (TDI), crude TDI, 4,4'-diphenylmethane diisocyanate (MDI), crude MDI, aliphatic polyisocyanates having carbon numbers of 2 to 18, and alicyclic polyisocyanates having carbon numbers of 4 to 15, as well as mixtures and modified ones of these polyisocyanate, e.g., prepolymers obtained by a partial reaction of polyisocyanates with polyols.

Particularly, a mixing ratio of polyisocyanate may be set to a small value for the purpose of reducing the hardness of the elastic body layer 12.

Examples of the polyamide resin include polyamides 6, 6.6, 6.10, 6.12, 11, 12 and 12.12, and polyamides obtained by polycondensation of different monomers of these polyimides, which are preferably dissoluble in alcohol from the standpoint of work performance. More specifically, a preferable example is prepared by methoxymethylating a polyamide obtained by adjusting the molecular weight of a ternary or tetrad copolymer of polyamides, or polyamide 6 or 12 so that a resulting one is dissoluble in alcohol or water. The urethane resin may be of, e.g., one- or two-solution type containing polyisocyanate. An epoxy resin or a melamine resin may be added as a cross-linking agent as required.

Further, one or more of the urethane resin, the polyamide resin and other modified resins may also be used in a mixed manner. By properly selecting materials of the resin layer 13 depending on a developing system, an amount of toner charges suitable for the developing system can be obtained.

The reason why carbon black is mixed in the resin layer 13 in the present invention is to give rubber conductivity. Carbon black used in the present invention is not limited to particular types so long as it satisfies predetermined values in three factors, i.e., (1) a DBP absorption amount, (2) a ratio of a DBP absorption amount to a nitrogen specific surface area, and (3) a ratio of a volatile component to a nitrogen specific surface area. Thus, conventionally known various types of carbon black, such as channel black and furnace black, are usable.

Depending on the purpose in use, the resistance of a rubber roller is required to be kept in a particular narrow region within the semiconductor range of about $10^3$–$10^{10}$Ω. If conductive carbon, e.g., Ketjenblack EC or acetylene black, is used in such a case, the resistance would greatly vary due to a slight change in the amount of conductive powder added and a failure of dispersion, thus resulting in a difficulty in control to obtain a predetermined resistance. The resistance is stabilized by employing carbons for usual rubbers, such as SAF, ISAF, HAF, MAF, FEF, GPF and SRF, whose structure is not so developed as the conductive carbon. However, a large amount of carbon must be mixed to reduce the resistance and mixing a large amount of carbon increases the hardness of rubber. Also, those types of carbon black have different degrees of dispersion and stability in a solvent or a solution depending on the particle size, structure and surface properties thereof.

In view of the above-described situations, it is important to select carbon black that has a low reinforcing ability and is optimized in both a level of structure and a state of surface properties. Although rubber having a low hardness and controlled so as to have a particular resistance value in the semiconductor range can also be obtained by using any of the above-mentioned conductive metal oxides, this material selection has a problem that the cost is substantially increased in comparison with the case of using carbon black.

The DBP absorption amount of carbon black means an amount of DBP absorbed by 100 g of carbon black, and is one of indices used for judging a level of structure of carbon black. The structure of carbon black is formed upon unit particles of the carbon black linking with each other into a chain form, and electrical conductivity of carbon black depends on a level of the structure. Additionally, in the present invention, the DBP absorption amount is measured in accordance with the stipulations of JIS K 6221.

The DBP absorption amount of the carbon black used in the present invention is preferably in the range of 80 to 110 ml/100 g. When the DBP absorption amount of the carbon black is not more than 110 ml/100 g, the structure of the carbon black is not increased to a level higher than necessary, and the modulus of elasticity of a conductive rubber roller can be kept small. Also, when the DBP absorption amount of the carbon black is not less than 80 ml/100 g, a sufficient conductivity can be given to rubber.

More preferably, the DBP absorption amount of the carbon black is in the range of 85 ml/100 g to 105 ml/100 g.

A mean particle size of the carbon black used in the present invention is not limited to a particular range, but it is restricted in terms of a ratio of a DBP absorption amount to a nitrogen specific surface area from the standpoints of dispersion and stability in a solution. The nitrogen specific surface area represents an amount of nitrogen adsorbed by 1 g of carbon black; that is, it represents a specific surface area of the carbon black, i.e., a particle size thereof. The ratio of the DBP absorption amount to the nitrogen specific surface area represents an amount of oil (DBP) absorbed per unit surface area of the carbon black, and serves as an index indicating a degree of development of the structure. The larger the ratio, the greater is an effect of reinforcing the resin layer and the higher is conductivity of the resin layer. Additionally, in the present invention, the nitrogen specific surface area ($N_2SA$) is measured in accordance with the stipulations of a method C in ASTM-D3037-78 "Carbon Black Surface Area Treating Standard Methods Based on Nitrogen Adsorption". The ratio of the DBP absorption amount to the nitrogen specific surface area of the carbon black used in the present invention is preferably not more than 0.012 ml/m$^2$.

When the ratio of the DBP absorption amount to the nitrogen specific surface area is not more than 0.012 ml/m$^2$, conductivity can be given to rubber without increasing the resin hardness to a level higher than necessary. Also, the structure level is not increased relative to the particle size and sufficient dispersion of aggregates can be ensured. More preferably, the ratio of the DBP absorption amount to the nitrogen specific surface area is not more than 0.0115 ml/m$^2$.

A volatile component of carbon black represents an amount of functional groups, such as a carboxyl group, a hydroxyl group and a quinone group, which are present on the surface of the carbon black, and it affects properties of the carbon black, i.e., dispersion, stability, and easiness of re-aggregation in a solvent. Additionally, in the present invention, the volatile component is measured in accordance with the stipulations of JIS K6221.

A ratio of a volatile component to a nitrogen specific surface area of the carbon black used in the present invention is preferably not more than $2.0\times10^{-4}$ g/m$^2$. When the ratio of the volatile component to the nitrogen specific surface area of the carbon black is not more than $2.0\times10^{-4}$ g/m$^2$, re-aggregation of the carbon black in a solvent is suppressed and a uniform coating is easier to obtain. Also, aggregated masses are less likely to occur when the resin including the carbon black is coated, and the occurrence of a leak can be prevented when the resulting roller is used as a developing one.

More preferably, the ratio of the volatile component to the nitrogen specific surface area of the carbon black is not more than $1.6\times20^{-4}$ g/m$^2$.

An amount of carbon black added is not limited to particular values because it depends on the types of carbon black used. Usually, however, the amount of carbon black is set so as to fall in the range of 5 to 85 weight parts and preferably in the range of 10 to 70 weight parts with respect to 100 weight parts of resin, as appropriate, depending on the conductivity and hardness that are required for a conductive rubber roller.

When the amount of mixed carbon black is not more than 85 weight parts, the conductivity and hardness of the conductive rubber roller are not excessively increased. Further, the conductivity becomes more uniform because of higher uniformity in distribution of the carbon black within the resin layer. On the other hand, when the amount of mixed carbon black is not less than 5 weight parts, the conductivity at a practically allowable level can be ensured. Moreover, the added carbon black can be sufficiently percolated, which contributes to increasing the stability of the conductivity.

For the purpose of adjusting the conductivity of rubber, in the present invention, metal oxides, graphite, etc. may be added in addition to the carbon black in such a range as not adversely affecting the advantages obtained by the present invention. Examples of a conductive agent, which is used for adjusting the conductivity, may be any of the ones described above as being added in the elastic body layer 12.

Also, for improving adhesion between the elastic body layer 12 and the resin layer 13, a silane coupler having an amino group may be added in the resin layer 13. Examples of the silane coupler include γ-aminopropyl trimethoxysilane, γ-aminopropyl triethoxysilane, N-phenyl-γ-aminopropyl trimethoxysilane, N-β-(aminoethyl)-γ-aminopropyl methyldimethoxysilane, N-β-(aminoethyl)-γ-aminopropyl trimethoxysilane, and methylaminoethoxypropyl dialkoxysilane.

An amount of silane coupler added in the resin layer 13 may be determined as appropriate depending on the use of a resulting roller, the type of resin, the type of coupler, the heating conditions, etc.

For forming the resin layer 13 on the surface of the elastic body layer 12, a method of coating a resin solution (conductive paint), in which the carbon black is dispersed, on the elastic body 13 can be effectively employed. A concentration of the resin component in the resin solution is not limited to particular values, but may be adjusted as appropriate depending on a required film thickness. However, the concentration of the resin component is preferably not less than 10% from the standpoints of dispersion and stability of the black carbon in the resin solution. A solvent used for preparing and adjusting the resin solution may be any suitable one so long as the resin material of the resin layer 13 is dissoluble in the solvent. Preferable examples of the solvent include lower alcohols such as methanol, ethanol and isopropanol, ketone such as methylethylketone, cyclohexane, toluene, and xylene. In particular, to obtain a good film forming ability by a drying step after the coating, it is preferable to employ a mixture of those solvents. Further, a dispersant may be added in the resin solution for further improving dispersion and stability of the carbon black. The resin solution can be applied by, e.g., spraying, roll coating or dipping after being properly adjusted. In the case of employing the dipping method, for example, a method may be used which comprises the steps of dipping a roller, on which the elastic body layer 12 is formed, in the resin solution within the above-mentioned concentration range for usually from 5 seconds to 3 minutes and preferably from 10 to 30 seconds at the room temperature, lifting the roller from the resin solution, and drying it. In the case of employing the spraying method, the resin concentration in the resin solution may be set to a higher value than in the case of employing the dipping method, and the resin solution adjusted to have a concentration not lower than 30% is also usable. In any case, the optimum resin concentration, applying method, and applying conditions are set so as to provide a desired film thickness. A thickness of the resin layer 13 is not limited to a particular range, but may be set as appropriate. However, the thickness of the resin layer 13 is preferably in the range of 0.1 to 100 μm and more preferably in the range of 1 to 30 μm. By setting the thickness of the resin layer 13 so as to fall in the above range, in the present invention, since the resin layer 13 is formed of a resin mixed with the above-described carbon black, the modules of elasticity of the resin layer 13 can be reduced while maintaining a satisfactory conductivity of the resin layer 13, and the setting ability required for the developing roller can be improved.

The conductive multiplayer coating preferably has a low surface hardness. In general, when the surface hardness is not more than 40° in terms of JIS-A hardness, a nip between the developing roller and a member to be charged is of very good evenness.

In operation of the thus-constructed developing roller according to the present invention, noticeable effects can be obtained with an addition of the carbon black satisfying the conditions, defined in the present invention, to a system in which silicone rubber is used in the elastic body layer and a urethane resin is used in the resin layer. Those effects, i.e., high dispersion and stability of the carbon black in a solution of a coating resin, and a low modules of elasticity and a high conductivity of a resin coating, are presumably attributable to the following fact. Generally, when carbon black is mixed in rubber or the like by using a Banbury mixer or a roll kneader, the carbon black having a smaller particle size and a lower structure level is harder to disperse. In other words, the carbon black having a larger particle size and a higher structure level is preferably employed for increasing the dispersion. However, when carbon black is added in a resin solution, there hardly occur shearing forces that contribute to dispersing aggregates of the carbon black, and hence it is fairly difficult to disperse the aggregates regardless of the structure level. Nevertheless, by selecting a balance between the particle size and the structure level so as to fall in a proper range, physical retaining forces of the aggregates are reduced and chemical characteristics at the surface are lessened for a reduction in chemical bonding forces. Consequently, when the carbon black is added in the resin solution, the aggregates become easier to disintegrate and disperse, while forming a state in which dispersed particles are harder to aggregate again. This approach enables the carbon black to be filled in greater weight parts than in the case of using the carbon black having a high structure level, and is also effective in forming a more homogeneous solution. In other words, an advantageous result is obtained to achieve a higher uniformity in film thickness and electrical resistance of the resin coating.

By selecting an optimum balance between the particle size and the structure level of the carbon black, an increase in the modulus of elasticity of the resin layer can be suppressed and a high conductivity can be efficiently given to the resin layer. The carbon black having a low surface activity also has a low reinforcing ability and further suppresses the modulus of elasticity, and higher dispersion is effective to increase the conductivity. This is because an increase of dispersion results in a higher conductivity even when the carbon black is added in an equal amount.

Thus, in the present invention, high dispersion and stability of the carbon black in the solution of the coating resin, and a low modulus of elasticity and a high conductivity of the coated resin layer are all ensured by optimizing a balance among the particle size, structure level and surface properties of the carbon black. Hence, a developing roller having a superior setting ability and a high uniform conductivity can be obtained by forming the resin layer having those excellent characteristics.

Figure 3:
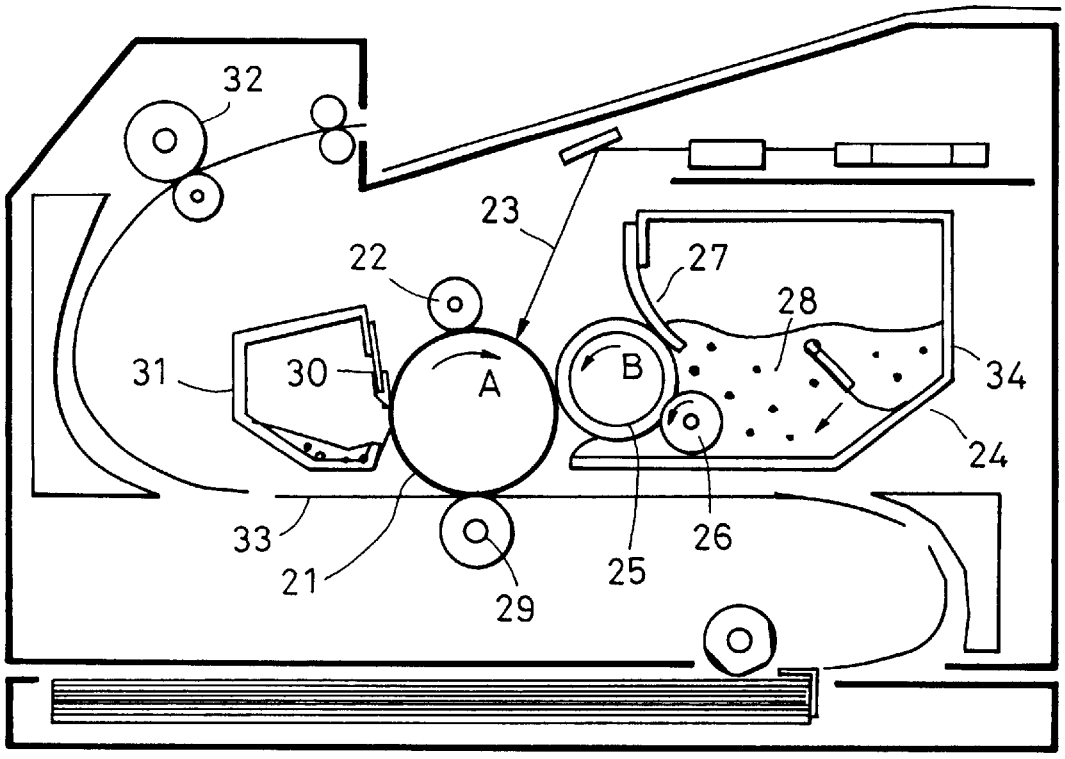
FIG. 3 is an explanatory view of a developing device according to one embodiment of the present invention.

FIG. 3 is a sectional view schematically showing a construction of an image forming apparatus using the developing device of the present invention.

A photoconductive drum 21 serving as a latent-image bearing member is rotated in a direction of arrow A and is uniformly charged by a charging device 22 that carries out charging of the photoconductive drum 21. An electrostatic latent image is then formed on the surface of the photoconductive drum 21 by a laser beam 23 that serves as an exposure means for writing the electrostatic latent image on the drum surface.

The electrostatic latent image is developed with toner, as a developer, into a visualized toner image. The toner is supplied from a developing device 24, which is arranged adjacent to the photoconductive drum 21 and is held by a process cartridge (not shown) detachably attached to a body of the image forming apparatus.

The development is carried out by the so-called reversal development method in which a toner image is formed in an exposed area.

The visualized toner image on the photoconductive drum 21 is transferred by a transfer roller 29 onto a sheet of paper 33 as a recording medium.

The sheet of paper 33, onto which the toner image has been transferred, is subjected to fusing of the toner image by a fusing device 32. The sheet of paper 33 is then ejected out of the apparatus, whereby the printing operation is completed.

Meanwhile, the toner remaining on the photoconductive drum 21 without being transferred is scraped off by a cleaning blade 30 and collected in a waste toner container 31. After the cleaning of the remaining toner, the photoconductive drum 21 is further rotated to repeat the processes described above.

The developing device 24 comprises a development container 34 in which nonmagnetic toner 28 is stored as a one-component developer, and a developing roller 25 as a developer bearing member which is positioned in an opening of the development container 34 formed to extend in the longitudinal direction thereof and is arranged in opposing relation to the photoconductive drum 21. The developing device 24 develops an electrostatic latent image on the photoconductive drum 21 into a visualized toner image.

Additionally, the developing roller 25 is in contact with the photoconductive drum 21 over a predetermined width.

In the developing device 24, an elastic roller 26 is rotatably supported within the development container 34 and is arranged in contact with the developing roller 25 at a position upstream of a contact area between an elastic blade 27 and the surface of the developing roller 25 in the rotating direction of the developing roller 25.

The elastic roller 26 is preferably of a sponge-like structure having a foamed skeleton or a fur brush structure in which fibers of rayon or nylon, for example, are planted on a core metal, from the standpoints of supplying the toner 28 to the developing roller 25 and scraping off the toner that has not been used in the developing process.

This embodiment uses the elastic roller 26 having a diameter of 16 mm and prepared by forming a polyurethane foam over a core metal.

An effective contact width of the elastic roller 26 with the developing roller 25 is in the range of 1 to 8 mm. Also, the elastic roller 26 is preferably rotated so as to have a proper relative speed in a contact area with respect to the developing roller 25. In this embodiment, the contact width is set to 3 mm, and the elastic roller 26 is rotated by a driving means (not shown) at the predetermined timing such that the elastic roller 26 has a circumferential speed of 50 mm/s in the developing operation (i.e., a relative speed of 130 mm/s with respect to the developing roller 25).

EXAMPLE

Example 1

The core shaft 11 was prepared by plating nickel on a SUS-made core metal, applying an adhesive on a nickel plating, and baking the adhesive. Then, the core shaft 11 was placed in a mold and a liquid silicone rubber material (an additive silicone rubber composition prepared by adding a platinum-based catalyst and organosiloxane having two or more silicon-bonded hydrogen atoms per molecule, both of which served as a cross-linking agent, 0.1 weight % of silica powder as a heat resistance imparting agent in the form of inorganic fine powder, and 30 weight % of carbon black as a conductivity imparting agent, to a polysiloxane mixture consisting of 40 weight % of normal chain polydimethylsiloxane having viscosity of 10000 Pa·s at 25° C. and closed by terminate vinyl groups, and 60 weight % of a block polymer made up of a branched polysiloxane segment having viscosity of 35 Pa·s at 25° C. and containing one vinyl group, and a normal chain oil segment containing about 200 molecules of dimethylsiloxane in succession having two functions) was poured into a cavity defined in the mold. Subsequently, the mold was heated to vulcanize the silicone rubber for hardening, and the hardened silicone rubber was released from the mold after cooling. As a result, the elastic body layer 12 was formed around the core shaft 11.

A urethane resin (trade name: Nipporan N5230, by Nippon Polyurethane Industry Co., Ltd.) was dissolved in methylethylketone as a main solvent and adjusted such that the urethane resin provides a solid component of 10%. Carbon black (trade name: Tokablack #7360SB, by Tokai Carbon Co., Ltd.) was further added in a mixture solution in amount of 16 weight parts with respect to the resin component, and was sufficiently agitated. A dipping solution was thereby obtained. The core shaft 11 having the elastic body layer 12 formed around it was immersed in the dipping solution for resin coating. Thereafter, the core shaft 11 was lifted, dried and subjected to heat treatment at 100° C. for two hours. As a result, the resin layer 13 was coated on an outer circumferential surface of the elastic body layer 12. A developing roller of Example 1 was thus obtained.

Example 2

A developing roller was obtained in the same manner as Example 1 except that the type and weight parts of added carbon black were changed, i.e., that 14 weight parts of carbon black (trade name: #32, by Mitsubishi Chemical Corporation) was added.

Example 3

A developing roller was obtained in the same manner as Example 1 except that the type and weight parts of added carbon black were changed, i.e., that 12 weight parts of carbon black (trade name: Printex 60, by Degussa) was added.

Comparative Example 1

A developing roller was obtained in the same manner as Example 1 except that the type and weight parts of added carbon black were changed, i.e., that 14 weight parts of carbon black (trade name: Raven 1040, by Columbian Chemicals Company) was added.

Comparative Example 2

A developing roller was obtained in the same manner as Example 1 except that the type and weight parts of added carbon black were changed, i.e., that 16 weight parts of carbon black (trade name: Asahi #70, by Asahi Carbon Co., Ltd.) was added.

Comparative Example 3

A developing roller was obtained in the same manner as Example 1 except that the type and weight parts of added carbon black were changed, i.e., that 14 weight parts of carbon black (trade name: #52, by Mitsubishi Chemical Corporation) was added.

Comparative Example 4

A developing roller was obtained in the same manner as Example 1 except that the type and weight parts of added carbon black were changed, i.e., that 5 weight parts of carbon black (trade name: VulcaenXC-72, by Cabot) was added.

Comparative Example 5

A developing roller was obtained in the same manner as Example 1 except that the type and weight parts of added carbon black were changed, i.e., that 3 weight parts of carbon black (trade name: Ketjenblack EC600JD, by Ketjenblack International) was added.

Subsequently, the developing rollers of Examples and Comparative Examples were evaluated for dispersion and stability of the carbon black in the resin solution, the modulus of elasticity of the coated resin layer, electrical resistance and a setting ability of the roller, and image unevenness. Evaluation results are listed in Table 1.

TABLE 1

| | Example 1 | Example 2 | Example 3 | Com. Example 1 | Com. Example 2 | Com. Example 3 | Com. Example 4 | Com. Example 5 |
|---|---|---|---|---|---|---|---|---|
| Type of Carbon Black | Toka-black #7360SB Tokai Carbon | #32 Mitsubi-shi Chemical | Printax 60 Degussa | Raven 1040 Colum-bian | Asahi #70 Asahi Carbon | #52 Mitsubi-shi Chemical | Vuican XC-72 Cabot | Ketjen-black EC600JD Ketjen-black Inter-national |

TABLE 1-continued

| | Example 1 | Example 2 | Example 3 | Com. Example 1 | Com. Example 2 | Com. Example 3 | Com. Example 4 | Com. Example 5 |
|---|---|---|---|---|---|---|---|---|
| Nitrogen Specific Surface Area [$m^2/g$] | 77 | 85 | 115 | 92 | 77 | 113 | 254 | 1270 |
| DBP Absorption Amount [ml/100 g] | 87 | 100 | 102 | 100 | 101 | 63 | 174 | 495 |
| Ratio of DBP Absorption Amount/ Nitrogen Specific Surface Area [$ml/m^2$] × $10^2$ | 1.13 | 1.18 | 0.89 | 1.09 | 1.31 | 0.56 | 0.69 | 0.39 |
| Volatile Component [%] | 1.0 | 0.6 | 1.0 | 2.6 | 1.3 | 0.8 | 1.5 | 0.7 |
| Ratioi of Volatile Component/Nitrogen Specific Surface Area [$g/m^2$] × $10^5$ | 13.0 | 7.1 | 8.7 | 28.3 | 16.9 | 7.1 | 5.9 | 0.6 |
| Amount Added (weight parts) | 16 | 14 | 12 | 14 | 16 | 14 | 5 | 3 |
| Modulus of Elasticity M100 [MPa] | 4.4 | 4.6 | 5.2 | 5.7 | 6.8 | 6.1 | 6.2 | 5.8 |
| Electrical Resistance [Ω] | Not more than $10^6$ | Not more than $10^6$ | Not more than $10^6$ | $10^8$ | $10^7$ | $10^7$ | Not more than $10^6$ | Not more than $10^6$ |
| Dispersion and Stability in Solution | ◎ | ○ | ○ | × | Δ | ○ | × | × |
| Setting Ability | ◎ | ◎ | ○ | ○ | × | Δ | Δ | ○ |
| Image | ◎ | ○ | ○ | × | × | Δ | × | Δ |
| Total Evaluation | ◎ | ○ | ○ | × | × | × | × | × |

◎ : best,
○ : good,
Δ: problematic,
×: bad

In the step of preparing the resin solution, the amount of added carbon black was adjusted so that the modulus of elasticity was held in a not excessively high range (about 6 MPa in terms of Modulus at 100% (i.e., the modulus of elasticity at 100% elongation) and the electrical resistance of the roller was held not more than $10^6\Omega$. In Comparative Examples 1, 2 and 3, the amount of added carbon black was adjusted based on the modulus of elasticity.

The dispersion of the carbon black in the resin solution was collectively evaluated from a time until a sufficient degree of dispersion was obtained by a ball mill (a time until reaching an equilibrium state), the presence or absence of aggregates by visual check in a sufficiently dispersed state), variations in surface roughness and resistance of the coated resin layer, the occurrence of precipitation or re-aggregation of the carbon black after standing. A mark ◎ represents a result that the carbon black was dispersed in a short time in a good condition; a mark ○ represents a result that a time was taken for the black carbon to disperse, but no problems were wound; a mark Δ represents a result that the carbon black was dispersed, but stability was poor; and a mark x represents a result that a sufficiently dispersed condition was not obtained. The best or good results were obtained in all of Examples 1 to 3 and Comparative Example 3. On the other hand, in Comparative Example 5, precipitation occurred after standing of the resin solution and a problem was found in stability. In Comparative Examples 1, 4 and 5, a stable dispersed condition was not obtained.

The setting ability of the roller was determined by leaving the roller to stand on a glass surface for two weeks while a weight of 1 kg was applied to each of both ends of the roller core shaft, and then measuring an amount of physical deformation. A mark ◎ represents a result that substantially no measurable deformation was found; a mark ○ represents a result that a slight deformation was found; a mark Δ represents a result that a deformation was found to such an extent as affecting image quality; and a mark x represents a result that a noticeable deformation was found. The best or good results were obtained in all of Examples 1 to 3 and Comparative Examples 1 and 5. However, a deformation was confirmed in Comparative Examples 3 and 4, and a more significant deformation was found in Comparative Example 2. These results of the setting ability were correlated to values of the modulus of elasticity. That is, the setting ability was good when the value of Modulus at 100% was not more than 5 MPa, and deteriorated as that value increased.

An image was evaluated by employing each of the fabricated roller as the developing roller of the image forming apparatus, shown in FIG. 3, and checking the presence or absence of any problem in a formed image. A mark ◎ represents a result that a good image was obtained; a mark ○ represents a result that the formed image had no problems; a mark Δ represents a result that slight unevenness of density was found in the image; and a mark x represents a result that a color missing or an apparent defective was found. A good image was obtained in Example 1, and the images had no problems in Examples 2 and 3. Slight unevenness of density was confirmed in Comparative Examples 3 and 5, and image failures were confirmed in Comparative Examples 1, 2 and 4.

According to total evaluation, no problems were found in Examples 1 to 3 for all of the dispersion and stability in the resin solution, the setting ability, and the image. Among three Examples, Example 1 showed the best result.

The present invention is not limited to the embodiment and examples described above, but includes modifications made without departing from the gist of the present invention. For example, while the resin layer is coated by dipping in the above-described Examples, it may be applied by any other suitable method, e.g., spraying or roll coating.

Also, the developing roller has been described as comprising the elastic body layer of silicone rubber and the resin layer of a urethane resin. However, an additional elastic body layer or resin layer may be further formed on the surface of the above-described developing roller, elastic body layer, and/or resin layer as required.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A developing roller comprising a core shaft and two or more layers formed on an outer circumferential surface of said core shaft, said layers including an elastic body layer made of rubber as a main ingredient and a resin layer coated at least on an outer surface of said elastic body layer, wherein said resin layer contains carbon black having a DBP absorption amount of 80 to 110 ml/100 g, a ratio of a DBP absorption amount to a nitrogen specific surface area being not more than 0.012 $ml/m^2$, and a ratio of a volatile component to a nitrogen specific surface area being not more than $2.0\times10^{-4}$ $g/m^2$.

2. A developing roller according to claim 1, wherein said elastic body layer made of rubber as a main ingredient is primarily made of silicone rubber.

3. A developing roller according to claim 1, wherein said resin layer is primarily made of a urethane resin.

4. A developing roller according to claim 1, wherein a film thickness of said elastic body layer is in the range of 0.5 to 6.0 mm.

5. A developing roller according to claim 1, wherein the DBP absorption amount of the carbon black is the range of 85 to 105 ml/100 g.

6. A developing roller according to claim 1, wherein the ratio of the DBP absorption amount to the nitrogen specific surface area of the carbon black is not more than 0.0115 $ml/m^2$.

7. A developing roller according to claim 1, wherein the ratio of the volatile component to the nitrogen specific surface area of the carbon black is not more than $1.6\times10^{-4}$ $g/m^2$.

8. A developing roller according to claim 1, wherein said resin layer contains 5 to 85 weight parts of the carbon black with respect to 100 weight parts of the resin forming said resin layer.

9. A developing roller according to claim 1, wherein a film thickness of said resin layer is in the range of 0.1 to 100 $\mu$m.

10. A developing device including a developing roller for carrying a developer in a state of abutment or pressure contact with an opposing latent-image bearing member for bearing a latent image thereon, said developing roller applying the developer to said latent-image bearing member, thereby visualizing the latent image into a developer image, wherein said developing roller is constituted by one of developing rollers according to claims 1 to 9.

* * * * *

UNITED STATES PATENT AND TRADEMARK OFFICE

CERTIFICATE OF CORRECTION

PATENT NO. : 6,393,243 B1
DATED : May 21, 2002
INVENTOR(S) : Hidenori Satoh et al.

It is certified that error appears in the above-identified patent and that said Letters Patent is hereby corrected as shown below:

Column 7,
Line 3, "JIS K 6221." should read -- JIS K6221. --.

Column 11,
Line 13, "EXAMPLE" should read -- EXAMPLES --.

Column 13,
In Table 1, " 1.31" should read -- 1.31 --; "Ratioi" should read -- Ratio --; and
" 28.3" should read -- 28.3 --; and
Line 45, "wound;" should read -- found; --.

Signed and Sealed this

Twenty-second Day of October, 2002

*Attest:*

*Attesting Officer*

JAMES E. ROGAN
*Director of the United States Patent and Trademark Office*